US011422482B2

(12) United States Patent
Iwai et al.

(10) Patent No.: US 11,422,482 B2
(45) Date of Patent: Aug. 23, 2022

(54) LIGHT-EMITTING DIODE EXPOSURE HEAD AND IMAGE FORMING APPARATUS INCLUDING LIGHT-EMITTING DIODE EXPOSURE HEAD

(71) Applicant: CANON KABUSHIKI KAISHA, Tokyo (JP)

(72) Inventors: Hitoshi Iwai, Chiba (JP); Shinichiro Hosoi, Tokyo (JP); Takehiro Ishidate, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/211,682

(22) Filed: Mar. 24, 2021

(65) Prior Publication Data

US 2021/0318636 A1 Oct. 14, 2021

(30) Foreign Application Priority Data

Apr. 8, 2020 (JP) ..... JP2020-069490

(51) Int. Cl.
*G03G 15/04* (2006.01)

(52) U.S. Cl.
CPC ..... *G03G 15/04054* (2013.01)

(58) Field of Classification Search
USPC ..... 399/220
See application file for complete search history.

(56) References Cited

U.S. PATENT DOCUMENTS

2018/0364610 A1* 12/2018 Okada ..... G03G 15/04036

FOREIGN PATENT DOCUMENTS

| | | | |
|---|---|---|---|
| JP | 2008284841 | A | 11/2008 |
| JP | 2016005876 | A | 1/2016 |
| JP | 2019001103 | A | 1/2019 |

* cited by examiner

*Primary Examiner* — Quana Grainger
(74) *Attorney, Agent, or Firm* — Canon U.S.A., Inc. I.P. Division

(57) ABSTRACT

A light-emitting diode exposure head includes a lens array, a long holder to hold the lens array, and a substrate having light-emitting diodes that emit light to expose a photosensitive member. The lens array includes lenses and condenses the light emitted from the light-emitting diodes on the photosensitive member. The long holder includes a base portion having an opening into which the lens array is inserted, and a pair of extended portions extended in a direction that is opposite of an emitting direction of the light along an optical axis of each of the lenses from both ends of the base portion in a transverse direction of the long holder. The pair of extended portions and the substrate are bonded in a state where leading edges of the pair of extended portions are in contact with a light-emitting surface of the substrate that serves as a surface of the substrate.

7 Claims, 13 Drawing Sheets

LIGHT-EMITTING DIODE EXPOSURE HEAD AND IMAGE FORMING APPARATUS INCLUDING LIGHT-EMITTING DIODE EXPOSURE HEAD

BACKGROUND

Field

The present disclosure relates to a light-emitting diode (LED) exposure head that exposes a photosensitive member to light emitted from LEDs, and an image forming apparatus including the LED exposure head.

Description of the Related Art

Some image forming apparatuses, such as a printer and a copying machine, include a light-emitting diode (LED) exposure head. The LED exposure head includes a plurality of LEDs, and a photosensitive member, such as a photosensitive drum, is exposed to light emitted from the plurality of LEDs. Some light sources for emitting light use an organic electroluminescence (EL). The organic EL is also called an organic light-emitting diode (OLED). The plurality of LEDs is arranged on a substrate, and the light emitted from the plurality of LEDs is condensed on the photosensitive member by a lens array.

Japanese Patent Application Laid-Open No. 2019-1103 discusses a holder that holds a substrate and a lens array. The holder includes a base portion having an opening into which the lens array is inserted, and a pair of extended portions extended in a transverse direction of the base portion from both ends of the base portion. In the holder, the base portion and the pair of extended portions form a U-shape. The substrate and the pair of extended portions are bonded with an adhesive in a state where the substrate is fit in a gap between the pair of extended portions.

However, in the configuration in which the substrate is held in the inside of the pair of extended portions, as in the LED exposure head discussed in Japanese Patent Application Laid-Open No. 2019-1103, there is a need to set a width between the pair of extended portions to be greater than the width of the substrate. Accordingly, the width of the holder is increased, which may lead to an increase in the size of each of the LED exposure head and the image forming apparatus in the width direction.

SUMMARY

According to an aspect of the present disclosure, a light-emitting diode exposure head includes a substrate including a plurality of light-emitting diodes configured to emit light to expose a photosensitive member, a lens array including a plurality of lenses and configured to condense the light emitted from the plurality of light-emitting diodes on the photosensitive member, and a long holder configured to hold the lens array, wherein the long holder includes a base portion having an opening into which the lens array is inserted, and a pair of extended portions extended in a direction that is opposite of an emitting direction of the light along an optical axis of each of the plurality of lenses from both ends of the base portion in a transverse direction of the long holder, and wherein the pair of extended portions and the substrate are bonded in a state where leading edges of the pair of extended portions are in contact with a light-emitting surface of the substrate that serves as a surface of the substrate.

Further features of the present disclosure will become apparent from the following description of exemplary embodiments with reference to the attached drawings.

BRIEF DESCRIPTION OF THE DRAWINGS

FIGS. 5A, 5B1, and 5B2 illustrate a substrate, and FIGS. 5C1 and 5C2 illustrate a lens array.

DESCRIPTION OF THE EMBODIMENTS

Modes for carrying out the present disclosure will be described below with reference to the accompanying drawings. Unless otherwise explicitly stated, the dimensions, materials, shapes, relative positions, and the like of components described below are not intended to limit the scope of the present disclosure.

(Image Forming Apparatus)

Figure 1A:
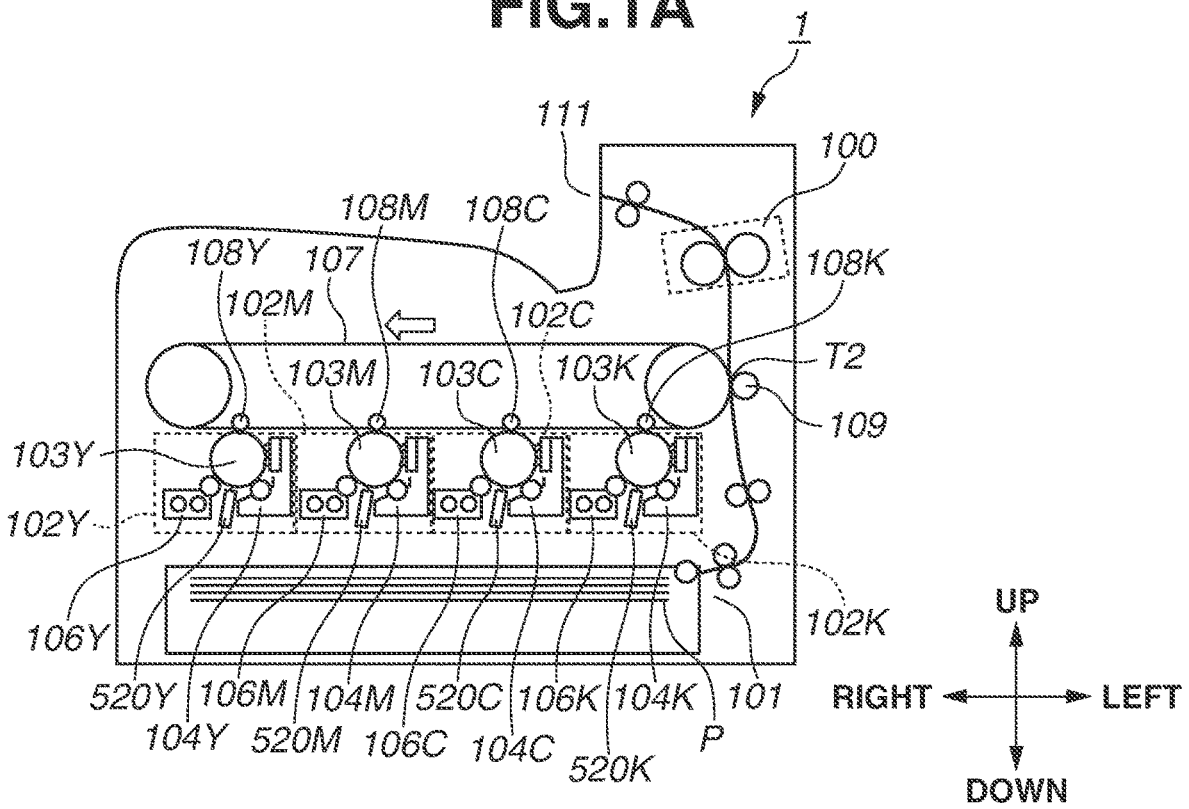
FIGS. 1A and 1B are schematic sectional views of an image forming apparatus.

A first exemplary embodiment of the present disclosure will be described below. A schematic configuration of an image forming apparatus 1 will now be described. FIG. 1A is a schematic sectional view of the image forming apparatus 1. The image forming apparatus 1 illustrated in FIG. 1A is a color printer (single function printer (SFP)) including no reading device, but instead may be a copying machine including a reading device. The present exemplary embodiment is not limited to a color image forming apparatus including a plurality of photosensitive drums 103 as illustrated in FIG. 1A, but instead may be a color image forming apparatus including a single photosensitive drum 103, or an image forming apparatus that forms a black-and-white image.

The image forming apparatus 1 illustrated in FIG. 1A includes four image forming units 102Y, 102M, 102C, and 102K (hereinafter also collectively referred to as an "image forming unit 102") that form toner images of respective colors of yellow, magenta, cyan, and black. The image forming units 102Y, 102M, 102C, and 102K include photosensitive drums 103Y, 103M, 103C, and 103K (hereinafter also collectively referred to as a "photosensitive drum 103"), respectively, which are examples of a photosensitive member. The photosensitive drum 103 may be a photosensitive belt. The image forming units 102Y, 102M, 102C, and 102K include chargers 104Y, 104M, 104C, and 104K (hereinafter also collectively referred to as a "charger 104"), respectively, as charging units that charge the photosensitive drums 103Y, 103M, 103C, and 103K, respectively. The image forming units 102Y, 102M, 102C, and 102K include light-emitting diode (LED) exposure units 520Y, 520M, 520C, and 520K (hereinafter also collectively referred to as an "exposure unit 520"), respectively, as exposure light sources that expose the photosensitive drums 103Y, 103M, 103C, and 103K, respectively, to light. Further, the image forming units 102Y, 102M, 102C, and 102K include developing devices 106Y, 106M, 106C, and 106K (hereinafter also collectively referred to as a "developing device 106"), respectively, as developing units that develop an electrostatic latent image on the photosensitive drum 103 with toner and develop the toner image of the corresponding color on the photosensitive drum 103. Symbols Y, M, C, and K represent yellow, magenta, cyan, and black colors of toner, respectively.

Figure 1B:
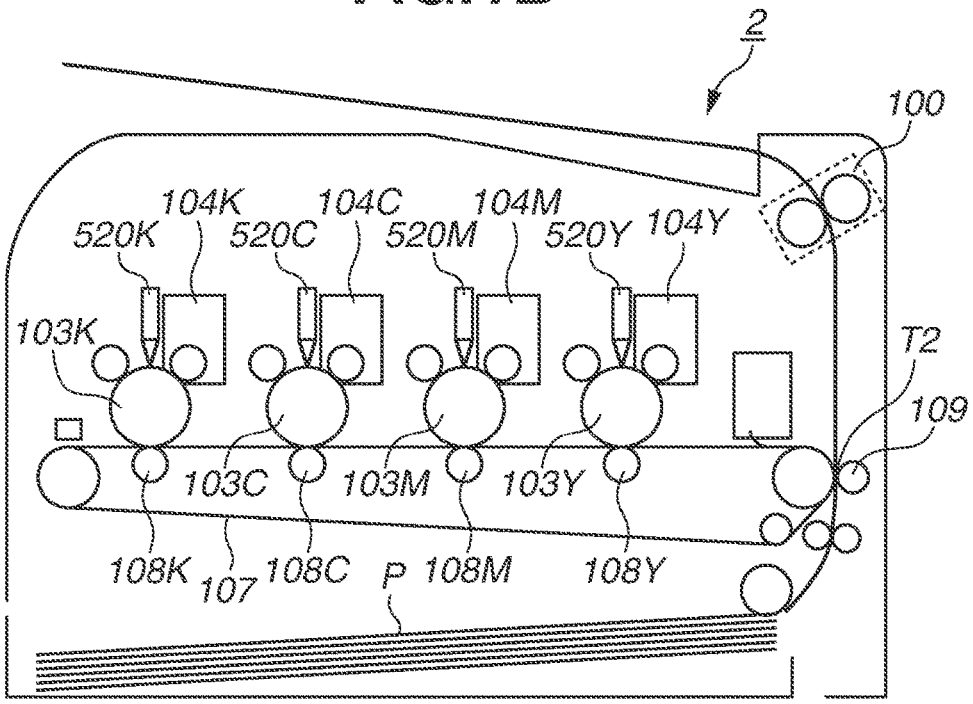

The image forming apparatus 1 illustrated in FIG. 1A is an image forming apparatus that adopts a "lower surface exposure method" for exposing the photosensitive drum 103 to light from below. The following description will be provided on the premise that the image forming apparatus 1 adopts the lower surface exposure method. However, the image forming apparatus 1 may adopt an "upper surface exposure method" for exposing the photosensitive drums 103 to light from above, like an image forming apparatus 2 illustrated in FIG. 1B. In FIG. 1B, portions that present the same configurations as those in FIG. 1A are denoted by the same reference symbols.

The image forming apparatus 1 includes an intermediate transfer belt 107 onto which the toner images formed on the photosensitive drum 103 are transferred, and primary transfer rollers 108 (Y, M, C, and K) that sequentially transfer the toner images formed on the photosensitive drum 103 to the intermediate transfer belt 107. Further, the image forming apparatus 1 includes a secondary transfer roller 109 that serves as a transfer unit and transfers the toner images on the intermediate transfer belt 107 onto a sheet of recording paper P conveyed from a sheet feeding unit 101, and a fixing device 100 that fixes the secondarily transferred images onto the recording paper P. Not only the intermediate transfer method using the intermediate transfer belt 107 as described above, but also a direct transfer method for directly transferring images onto a sheet from the photosensitive drum 103 may be used.

(Image Forming Process)

The surface of the photosensitive drum 103Y charged by the charger 104Y is exposed to light by the exposure unit 520Y. As a result, an electrostatic latent image is formed on the surface of the photosensitive drum 103Y. Next, the developing device 106Y develops the electrostatic latent image formed on the surface of the photosensitive drum 103Y with yellow toner. The yellow toner image developed on the surface of the photosensitive drum 103Y is transferred onto the intermediate transfer belt 107 by the primary transfer roller 108Y. Magenta, cyan, and black toner images are also transferred onto the intermediate transfer belt 107 through a similar image forming process.

The toner color images of the respective colors transferred onto the intermediate transfer belt 107 are conveyed to a secondary transfer portion T2 by the intermediate transfer belt 107. A transfer bias for transferring the toner images onto the recording paper P is applied to the secondary transfer roller 109 that is disposed at the secondary transfer portion T2. The transfer bias applied to the secondary transfer roller 109 causes the toner images conveyed to the secondary transfer portion T2 to be transferred onto the recording paper P conveyed from the sheet feeding unit 101. The recording paper P onto which the toner images are transferred is conveyed to the fixing device 100. The fixing device 100 fixes the toner images onto the recording paper P with heat and pressure. The recording paper P on which the fixation process has been performed by the fixing device 100 is discharged onto a sheet discharge portion 111.

(Drum Unit and Developing Unit)

Drum units 518Y, 518M, 518C, and 518K (hereinafter also collectively referred to as a "drum unit 518") including the photosensitive drum 103Y, 103M, 103C, and 103K, respectively, are mounted on the image forming apparatus 1. The drum unit 518 is a cartridge that is replaced by an operator, such as a user or maintenance personnel. The drum unit 518 rotatably supports the photosensitive drum 103. In this case, the drum unit 518 also functions as a drum support member that rotatably supports the photosensitive drum 103. In the present exemplary embodiment, the drum unit including the drum support member is referred to as the drum unit 518. Specifically, the photosensitive drum 103 is rotatably supported by a frame of the drum unit 518. The drum unit 518 need not necessarily include the charger 104 and a cleaning device.

Developing units 641Y, 641M, 641C, and 641K (hereinafter also collectively referred to as a "developing unit 641") are mounted on the image forming apparatus 1 according to the present exemplary embodiment as members separate from the drum unit 518. The developing unit 641 according to the present exemplary embodiment is a cartridge having a configuration in which the developing device 106 illustrated in FIG. 1A and a toner storage portion are integrated. The developing device 106 includes a developing sleeve (not illustrated) that carries developer. The developing unit 641 is provided with a plurality of gears that rotate a screw for mixing the toner and carrier. For example, when the gears have degraded with time, the operator detaches the developing unit 641 from an apparatus body of the image forming apparatus 1 and replaces the developing unit 641. Each of the drum unit 518 and the developing unit 641 according to the present exemplary embodiment may be a process cartridge having a configuration in which the drum unit 518 and the developing unit 641 described above are integrated.

Figure 2A:
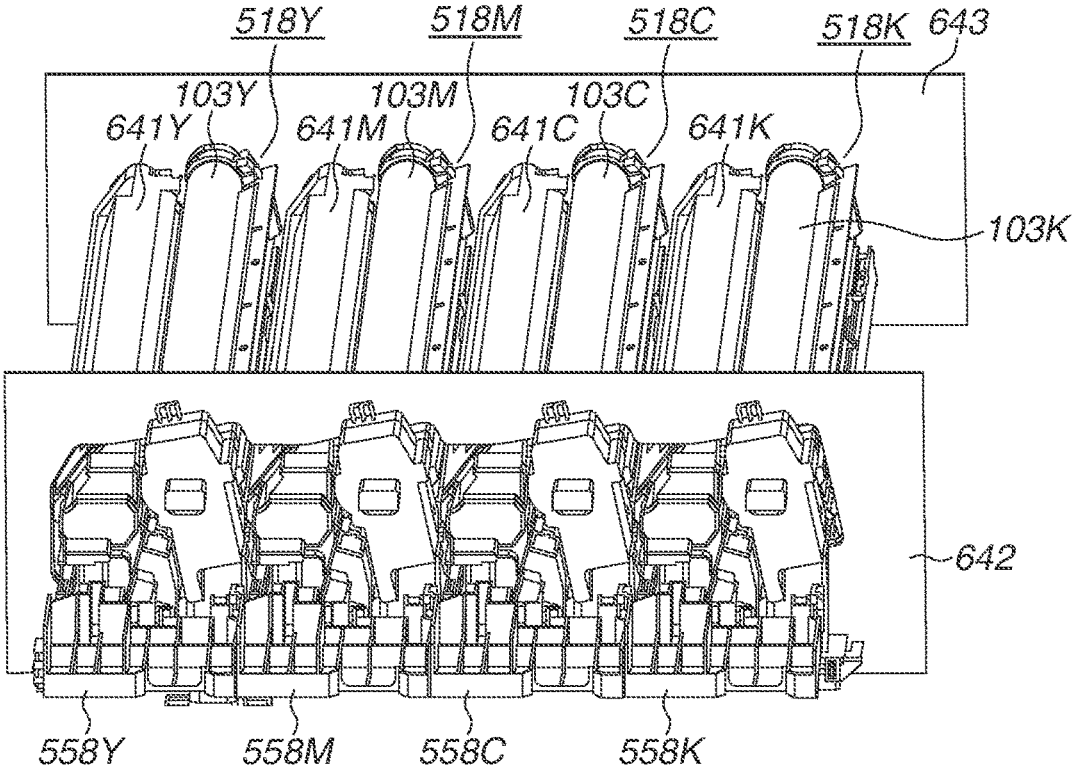
FIGS. 2A and 2B are views each illustrating a configuration in the vicinity of drum units.
Figure 2B:
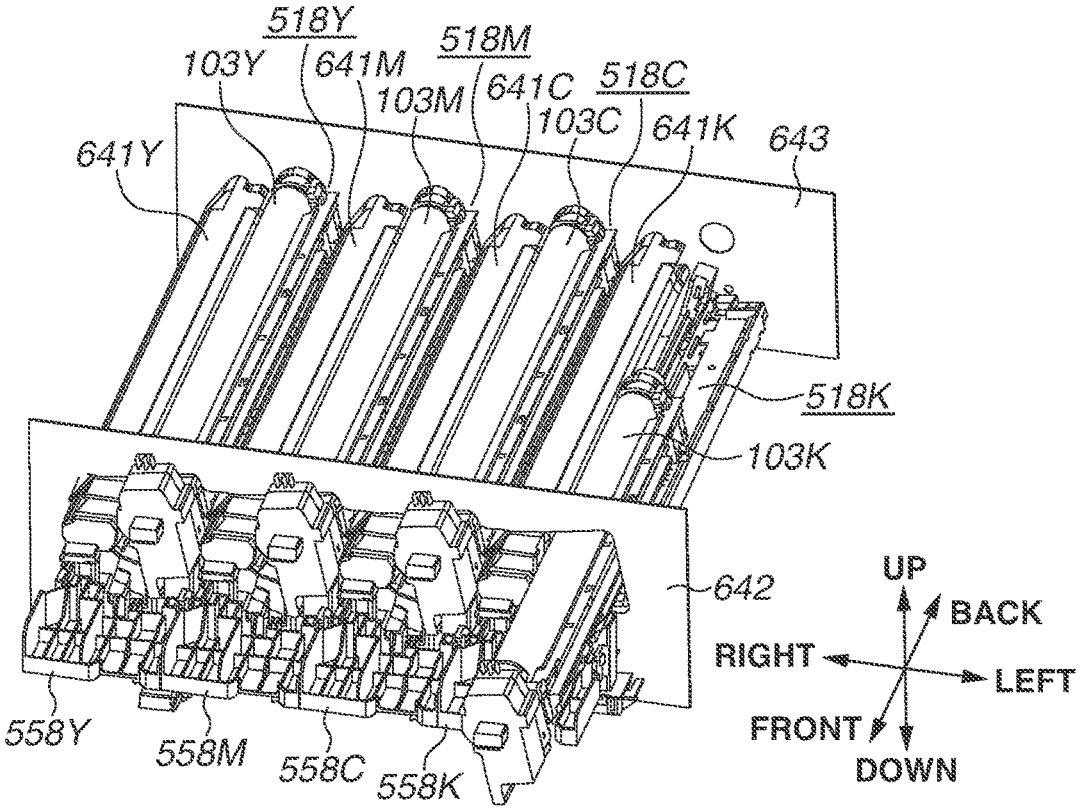

FIG. 2A is a perspective view illustrating a schematic structure in the vicinity of the drum units 518 (Y, M, C, K) and the developing units 641 (Y, M, C, K) included in the image forming apparatus 1. FIG. 2B is a view illustrating a state where the drum units 518 are inserted into the image forming apparatus 1 from the outside of the apparatus body.

As illustrated in FIG. 2A, the image forming apparatus 1 includes a front side plate 642 that is formed of a plate, and a back side plate 643 that is also formed of a plate. The front side plate 642 is a side wall provided on the front side of the image forming apparatus 1. The front side plate 642 constitutes a part of a housing of the apparatus body on the front side of the apparatus body of the image forming apparatus 1. The back side plate 643 is a side wall provided on the back side of the image forming apparatus 1. The back side plate 643 constitutes a part of the housing of the apparatus body on the back side of the main body of the image forming apparatus 1. As illustrated in FIG. 2A, the front side plate 642 and the back side plate 643 are arranged to be opposed to each other, and a plate (not illustrated) serving as a beam is bridged over the front side plate 642 and the back side plate 643. The front side plate 642, the back side plate 643, and the beam (not illustrated) constitute a part of the frame of the image forming apparatus 1. The term "front surface side" or "front side" of the image forming apparatus 1 or the components thereof according to the present exemplary embodiment refers to a side where the drum unit 518 is inserted into or removed from the apparatus body.

The front side plate 642 is provided with an opening into which the drum unit 518 and the developing unit 641 can be inserted into or removed from, on the front side of the image forming apparatus 1. The drum unit 518 and the developing unit 641 are mounted at predetermined positions (mounting positions) in the apparatus body of the image forming apparatus 1 through the opening. The image forming apparatus 1 includes covers 558Y, 558M, 558C, and 558K (hereinafter also collectively referred to as a "cover 558") that cover the front side of each of the drum unit 518 and the developing unit 641 that are mounted at the mounting positions. One end of the cover 558 is fixed to the apparatus body of the image forming apparatus 1 with a hinge. The hinge enables the cover 558 to pivot relative to the main body of the image forming apparatus 1. The operator completes the replacing work by opening the cover 558 and taking out the drum unit 518 or the developing unit 641 from the main body, and by inserting a new drum unit 518 or a new developing unit 641 and closing the cover 558.

As illustrated in FIGS. 2A and 2B, a side where the front side plate 642 is located is hereinafter defined as the front side (or the front surface side) of the apparatus body, and a side where the back side plate 643 is located is hereinafter defined as the back side (or the back surface side) of the apparatus body. With reference to the photosensitive drum 103K on which the electrostatic latent image for the black toner image is formed, a side where the photosensitive drum 103Y on which the electrostatic latent image for the yellow toner image is formed is disposed is defined as a right side. With reference to the photosensitive drum 103Y on which the electrostatic latent image for the yellow toner image is formed, a side where the photosensitive drum 103K on which the electrostatic latent image for the black toner image is formed is disposed is defined as a left side. A direction that is perpendicular to the front-back direction and left-right direction defined herein and that is a vertically upward direction is defined as an up direction, and a direction that is perpendicular to the front-back direction and left-right direction defined herein and that is a vertically downward direction is defined as a down direction. The front direction, the back direction, the right direction, the left direction, the up direction, and the down direction, which are defined above, are illustrated in FIG. 2B. The term "rotational axis direction" of the photosensitive drum 103 used herein refers to a direction that coincides with the front-back direction illustrated in FIG. 2B. The term "longitudinal direction" of a LED print head (which is an example of a LED exposure head) 105 also refers to the direction that coincides with the front-back direction illustrated in FIG. 2B. In other words, the rotational axis direction of the photosensitive drum 103 and the longitudinal direction of the LED print head 105 coincide with each other.

(Exposure Unit)

Next, the exposure unit 520 including the LED print head 105 will be described. The LED print head 105 has an elongated shape extending in the rotational axis direction of the photosensitive drum 103. The LED print head 105 includes a holding member 505 (which is an example of a holder), a lens array 506, and a substrate (not illustrated). The lens array 506 and the substrate are held by the holding member 505. In the present exemplary embodiment, the holding member 505 is made of metal and is formed by bending a plate material obtained by performing a plating process on a galvanized steel plate or cold-rolled steel plate into a U-shape. However, the holding member 505 is not limited to a member made of metal, but instead may be a member made of resin. An example of an exposure method adopted for an electrophotographic image forming apparatus is a laser beam scanning exposure method for performing scanning with an irradiation beam from a semiconductor laser using a polygon mirror or the like to expose the surface of the photosensitive drum to light through an f-O lens or the like. The "LED print head 105" described in the present exemplary embodiment is used for a LED exposure method for exposing the surface of the photosensitive drum 103 to light using light-emitting elements, such as LEDs, that are arranged along the rotational axis direction of the photosensitive drum 103, and is not used for the above-described laser beam scanning exposure method.

Figure 3:
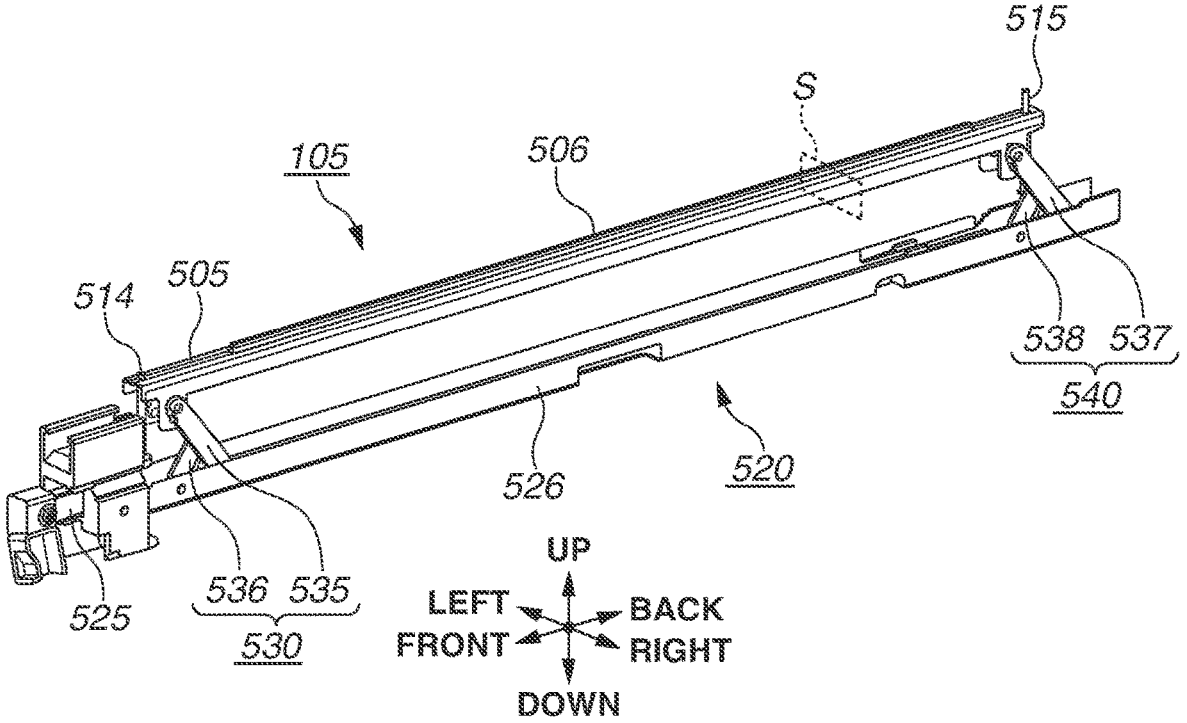
FIG. 3 is a schematic perspective view of a light-emitting diode (LED) exposure head.

The exposure unit 520 described in the present exemplary embodiment is provided on the lower side in the vertical direction relative to the rotational axis of the photosensitive drum 103. LEDs serving as light-emitting elements are provided on the substrate (not illustrate) included in the holding member 505, and these light-emitting elements expose the surface of the photosensitive drum 103 to light from below. However, the exposure unit 520 may be provided on the upper side in the vertical direction relative to the rotational axis of the photosensitive drum 103 and may expose the surface of the photosensitive drum 103 to light from above (see FIG. 1B). FIG. 3 is a schematic perspective view illustrating the exposure unit 520 included in the image forming apparatus 1 according to the present exemplary embodiment.

As illustrated in FIG. 3, the exposure unit 520 includes the LED print head 105, a support member 526, a first link mechanism 530, and a second link mechanism 540.

As illustrated in FIG. 3, the holding member 505 of the LED print head 105 is provided with a contact pin 514 and a contact pin 515. The contact pin 514 and the contact pin 515 are examples of a pin made of metal. For example, the contact pin 515 is provided on the holding member 505 on one side (back side) of the lens array 506 in the rotational axis direction of the photosensitive drum 103, and the contact pin 515 projects from both sides of the holding member 505 in the optical axis direction of the lens array 506. The contact pin 514 has a configuration similar to that of the contact pin 515. When the contact pin 514 and the contact pin 515 are brought into contact with the drum unit 518, a gap is formed between the lens array 506 and the photosensitive drum 103. Thus, the position of the LED print head 105 relative to the photosensitive drum 103 is determined. In the present exemplary embodiment, the contact pin 514 and the contact pin 515 are straight pins made of metal. The contact pin 514 and the contact pin 515 are fixed to the holding member 505, which is made of metal, by welding. Thus, in the present exemplary embodiment, the contact pin 514 and the contact pin 515 are integrally formed with the holding member 505.

The first link mechanism 530 includes a link member 535 and a link member 536. The second link mechanism 540 includes a link member 537 and a link member 538. As described in detail below, the link member 535 is attached to the back side relatively to the center of the holding member 505 in the rotational axis direction of the photosensitive drum 103, and the link member 537 is attached to the front side relatively to the center of the holding member 505 in the rotational axis direction of the photosensitive drum 103.

A slide member 525 is slidably moved in the front-back direction along with an opening/closing operation of the cover 558 provided on the front side of the image forming apparatus 1. The link members 535 to 538 are rotated along with the slidable movement of the slide member 525, thus enabling the LED print head 105 to move in the up-down direction.

In the present exemplary embodiment, the LED print head 105 is provided on the lower side in the vertical direction relatively to the photosensitive drum 103. In other words, in the image forming apparatus 1 according to the present exemplary embodiment, the LED print head 105 exposes the surface of the photosensitive drum 103 to light from below in the vertical direction.

As illustrated in FIG. 3, the exposure unit 520 includes the support member 526. The support member 526 supports the LED print head 105 via the first link mechanism 530 and the second link mechanism 540. Specifically, the link member 535 of the first link mechanism 530 supports the holding member 505, and the link member 537 of the second link mechanism 540 supports the holding member 505.

The support member 526 is formed by bending a plate into a U-shape. The support member 526 is a member having a longitudinal shape extending in the rotational axis direction of the photosensitive drum 103. One end (front side) of the support member 526 in the longitudinal direction of the support member 526 is fixed to the front side plate 642, and the other end (back side) of the support member 526 in the longitudinal direction of the support member 526 is fixed to the back side plate 643. Thus, the position of the support member 526 with respect to the photosensitive drum 103 is fixed on the side that is opposite to the side where the photosensitive drum 103 is disposed with respect to the holding member 505.

The support member 526 includes the slide member 525 that is movable in the longitudinal direction of the support member 526. Along with the movement of the slide member 525 relative to the support member 526, the link members 535 to 538 are rotated, thus moving the LED print head 105 relatively to the support member 526.

Figure 4A:
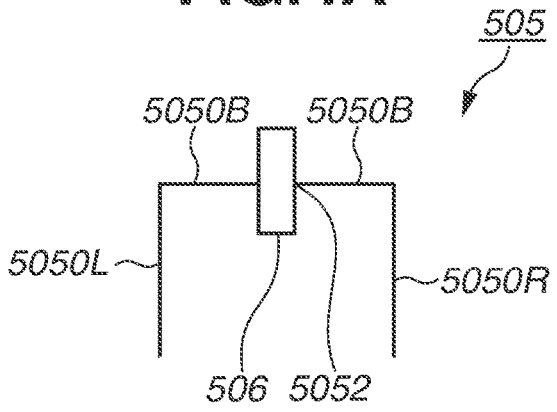
FIGS. 4A to 4D are schematic views illustrating an example of a sectional shape of a holding member.
Figure 4B:
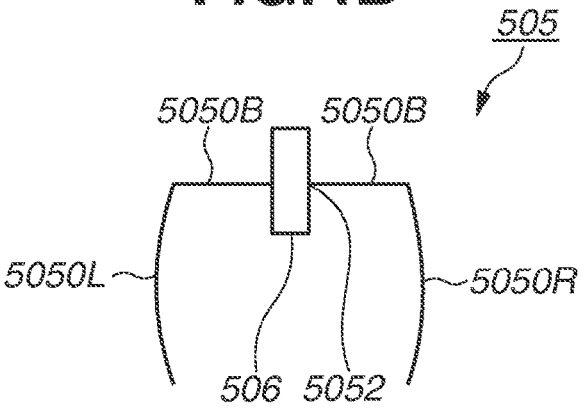
Figure 4C:
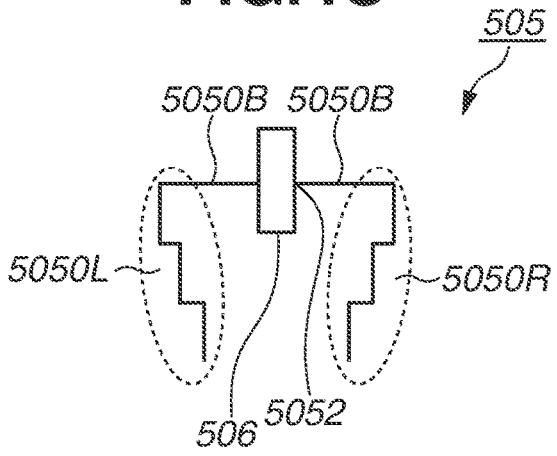
Figure 4D:
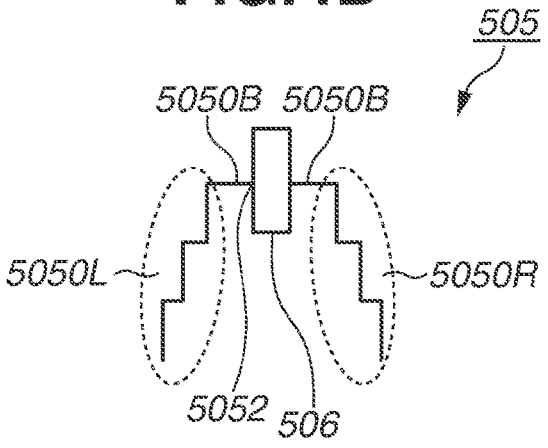

FIGS. 4A to 4D are schematic views each illustrating a section of the holding member 505 illustrated in FIG. 3 when the section is taken along a plane S illustrated in FIG. 3. An example of a portion to be cut when a sectional shape is considered is a plane that passes through the lens array 506 and is vertical to the longitudinal direction of the holding member 505. A section of the holding member 505 according to the present exemplary embodiment has a shape illustrated in FIG. 4A, but instead may have, for example, shapes as illustrated in FIGS. 4B to 4D. As described above, the holding member 505 has a U-shape. Specifically, the holding member 505 may have such a shape that a pair of extended portions 5050R and 5050L is curved as illustrated in FIG. 4B, or such a shape that each of the pair of extended portions 5050R and 5050L has a step shape as illustrated in FIGS. 4C and 4D, as long as the pair of extended portions 5050R and 5050L is extended from, respectively, the right and left ends of a base portion 5050B that holds the lens array 506.

(Substrate and Lens Array)

Figure 5A:
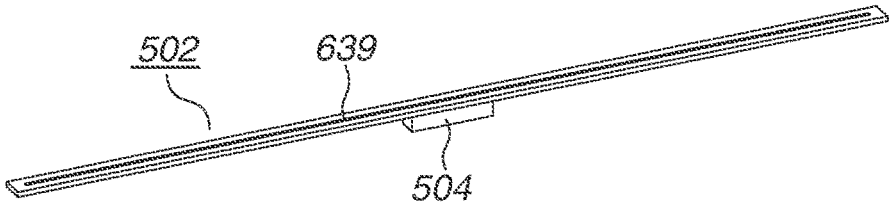
Figure 5A:
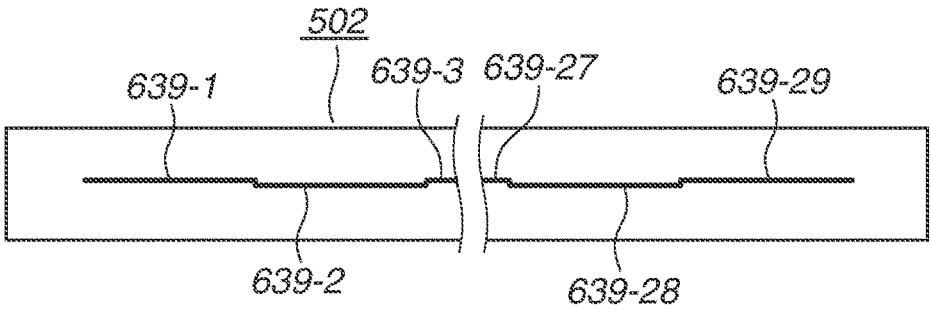
Figure 5A:
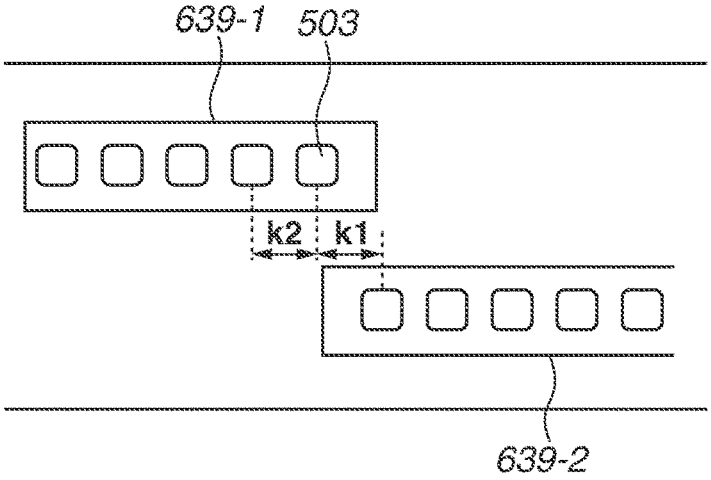
Figure 5A:
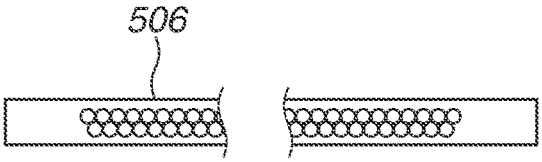
Figure 5A:
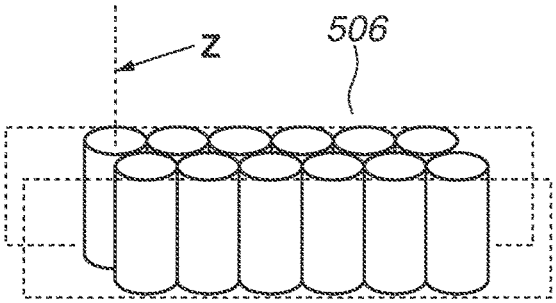

Next, a substrate 502 and the lens array 506, which are held by the holding member 505, will be described with reference to FIGS. 5A, 5B1, 5B2, 5C1, and 5C2. First, the substrate 502 will be described. FIG. 5A is a schematic perspective view of the substrate 502. FIG. 5B1 illustrates an array of a plurality of LEDs 503 provided on the substrate 502. FIG. 5B2 is an enlarged view of FIG. 5B1.

LED chips 639 are mounted on the substrate 502. As illustrated in FIG. 5A, the LED chips 639 are provided on one surface of the substrate 502, and a connector 504 is provided on the back side of the substrate 502. The term "one surface" used herein, or the surface on which the LED chips 639 are provided, is defined as a "light-emitting surface". In other words, one of the front and back surfaces of the substrate 502 from which light is emitted to the photosensitive drum 103 corresponds to the light-emitting surface. The substrate 502 is provided with wiring for supplying a signal to each LED chip 639. The connector 504 is connected to one end of a flexible flat cable (FFC) (not illustrated). The substrate 502 includes a control portion and a connector. The other end of the FFC is connected to the connector. A control signal is input to the substrate 502 from the control portion in the apparatus body of the image forming apparatus 1 through the FFC and the connector 504. Each LED chip 639 is driven by the control signal input to the substrate 502.

Each LED chip 639 mounted on the substrate 502 will be described in more detail. As illustrated in FIGS. 5B1 and 5B2, a plurality of (29) LED chips 639-1 to 639-29 on which the plurality of LEDs 503 is arranged is arranged on one surface of the substrate 502. On each of the LED chips 639-1 to 639-29, a row of 516 LEDs is arranged in the longitudinal direction of each LED chip. A center-to-center distance k2 between LEDs that are adjacent to each other in the longitudinal direction of each LED chip 639 corresponds to a resolution of the image forming apparatus 1. The resolution of the image forming apparatus 1 according to the present exemplary embodiment is 1200 dpi. Accordingly, the LED chips 639-1 to 639-29 are arranged in a row in the longitudinal direction of each LED chip 639 with a center-to-center distance between adjacent LEDs of 21.16 μm. Therefore, the LED print head 105 according to the present exemplary embodiment has an exposure range of about 316 mm. A photosensitive layer of the photosensitive drum 103 is formed with a width of 316 mm or more. Since the length of a long side of a sheet of A4-sized recording paper and the length of a short side of a sheet of A3-sized recording paper are 297 mm, the LED print head 105 according to the present exemplary embodiment has the exposure range that enables image formation on A4-sized recording paper and A3-sized recording paper.

The LED chips 639-1 to 639-29 are arranged alternately in two rows along the rotational axis direction of the photosensitive drum 103. In other words, as illustrated in FIG. 5B1, the odd-numbered LED chips 639-1, 639-3, . . . , and 639-29 when counted from the left side are mounted in one row in the longitudinal direction of the substrate 502, and the even-numbered LED chips 639-2, 639-4, . . . , and 639-28 are mounted in one row in the longitudinal direction of the substrate 502. By arranging the LED chips 639 in such a manner, a center-to-center dimension k1 between a LED arranged at one end of one of different LED chips 639 arranged adjacent to each other in the longitudinal direction of the LED chip 639 and an LED arranged at the other end of the other one of the different LED chips 639 arranged adjacent to each other can be set to be equal to the center-to-center dimension k2 between adjacent LEDs on a single LED chip 639, as illustrated in FIG. 5B2.

In the present exemplary embodiment, the light-emitting elements are semiconductor LEDs that are light-emitting diodes, but instead may be, for example, organic light-emitting diodes (OLEDs). Each OLED is also called an organic electroluminescence (EL) and is a current-driven light-emitting element. The OLEDs are arranged, for example, on a line along a main scanning direction (rotational axis direction of the photosensitive drum 103) on a thin film transistor (TFT) substrate, and are electrically connected in parallel with a power supply wire that is also provided along the main scanning direction.

Next, the lens array 506 will be described. FIG. 5C1 is a schematic view of the lens array 506 as viewed from the side where the photosensitive drum 103 is located. FIG. 5C2 is a schematic perspective view of the lens array 506. As illustrated in FIG. 5C1, a plurality of lenses is arranged in two rows along the array direction of the plurality of LEDs 503. The lenses are arranged alternately so that one of lenses in a row is arranged to contact both of adjacent lenses in the array direction of lenses in the other row. Each lens is a columnar rod lens made of glass, and includes an incoming surface into which the light emitted from each LED 503 enters and an outgoing surface through which the light entering from the incoming surface exits. The material of each lens is not limited to glass, but instead may be, for example, plastic. The shape of each lens is not limited to a columnar shape. For example, each lens may have a polygonal prism shape such as a hexagonal cylindrical shape.

A broken line Z illustrated in FIG. 5C2 represents an optical axis of a lens. The LED print head 105 is moved by a moving mechanism 640 substantially in the direction of the optical axis of the lens indicated by the broken line Z. The term "optical axis" of the lens described herein refers to a line that connects the center of the light-emitting surface of the lens and the focal point of the lens. Since the lens array 506 includes a plurality of lenses, there is a plurality of "lens optical axes". However, these optical axes are substantially parallel to each other. Accordingly, when the "lens optical axis" in the lens array 506 is defined, any one of the plurality of lenses included in the lens array 506 may be selected and the optical axis of the selected lens may be defined as the lens optical axis. The lens array 506 functions to condense the light emitted from each LED 503 on the surface of the photosensitive drum 103.

The plurality of LEDs 503 and the lens array 506 provided on the substrate 502 described above are held by the holding member 505 in such a manner that the LEDs 503 and the lens array 506 are opposed to each other. Thus, the light emitted from the plurality of LEDs 503 is condensed on the surface of the photosensitive drum 103 by the lens array 506. In the present exemplary embodiment, the light emitted from three LEDs 503 (plurality of LEDs 503) can pass through a single lens. Moreover, light emitted from a single LED 503 travels radially, and thus the light can pass through a plurality of lenses. In other words, the light emitted from the plurality of LEDs 503 passes through the lens array 506 (some of the plurality of lenses included in the lens array 506) and exposes the photosensitive drum 103.

An OLED may be used as a light source that emits light to expose the photosensitive drum 103. A substrate using an OLED as a light source will be described with reference to FIG. 6 and FIGS. 7A to 7C.

Figure 6:
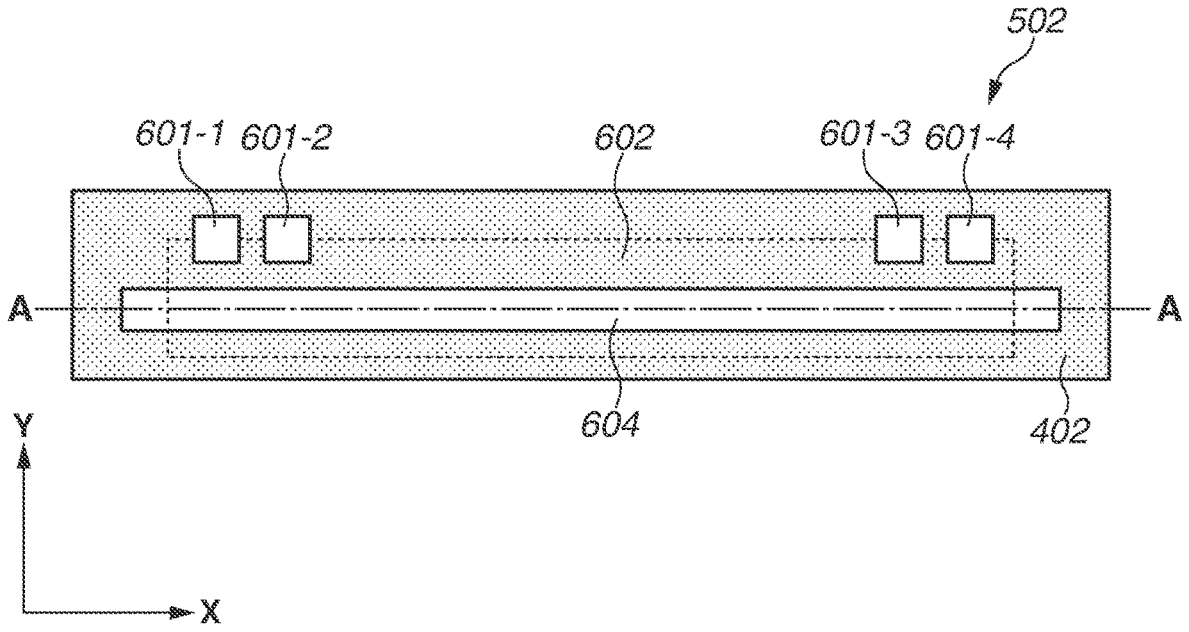
FIG. 6 is a diagram illustrating the substrate including an organic light-emitting diode (OLED).

FIG. 6 is a diagram illustrating the substrate 502 when the OLED is used as each light-emitting element. FIG. 6 illustrates an internal configuration of the substrate 502. As illustrated in FIG. 6, the longitudinal direction of the substrate 502 is defined as an X-direction and the transverse direction of the substrate 502 is defined as a Y-direction. The Y-direction can also be referred to as a rotational direction of the photosensitive drum 103, or a movement direction of the photosensitive surface (photosensitive member surface) of the rotating photosensitive drum 103. The X-direction is substantially orthogonal to the Y-direction or the rotational direction of the photosensitive drum 103. In other words, the X-direction is substantially parallel to the rotational axis direction of the photosensitive drum 103. The "substantially orthogonal" direction allows an inclination of about ±1° with respect to an angle of 90°, and the "substantially parallel" direction allows an inclination of about ±1° based on an angle of 0° formed between the directions. Specifically, the longitudinal direction of the substrate 502 may be inclined by about ±1° with respect to the rotational axis direction of the photosensitive drum 103. The transverse direction of the substrate 502 may be inclined by about ±1° with respect to the rotational direction of the photosensitive drum 103. The substrate 502 has a configuration in which wire bonding pads (hereinafter referred to as WB pads) 601-1, 601-2, 601-3, and 601-4 are formed on a silicon substrate 402. The silicon substrate 402 incorporates a circuit portion 602 (as indicated by a broken line). As the circuit portion 602, an analog drive circuit, a digital control circuit, or a configuration including both of the analog drive circuit and the digital control circuit can be used. Power supply to the circuit portion 602 and input/output of signals or the like from the outside of the exposure unit 520 are carried out through the WB pads 601-1 to 601-4.

The substrate 502 including the OLED includes a line-shaped light-emitting region 604 extending along the rotational axis direction of the photosensitive drum 103. The light-emitting region 604 includes an anode, a cathode, and a light-emitting layer 450 (see FIGS. 7A and 7B) to be described below. The light-emitting region 604 is a region where light is emitted when a potential difference is generated between the anode and the cathode.

The circuit portion 602 is provided with a drive portion that drives the light-emitting region 604 and a data transfer/light-emitting signal generation portion that generates a signal for causing the light-emitting region 604 to emit light (the signal is hereinafter referred to as a light-emitting signal). The circuit portion 602 is formed on the silicon substrate 402. Thus, the circuit that enables high-speed processing can be formed.

Figure 7A:
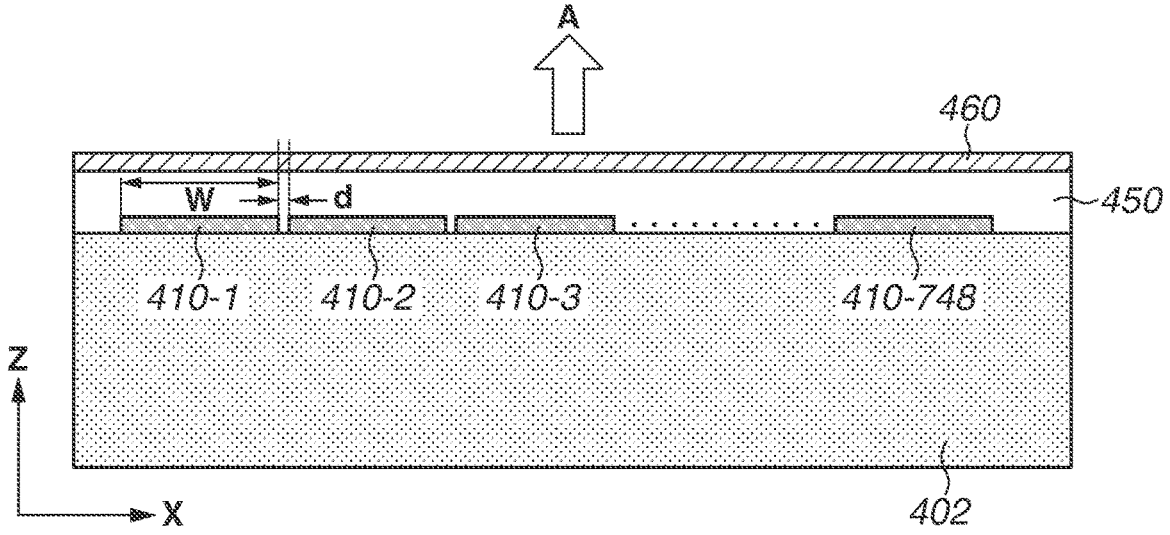
FIGS. 7A, 7B, and 7C are diagrams each illustrating an internal structure of the substrate including the OLED.
Figure 7B:
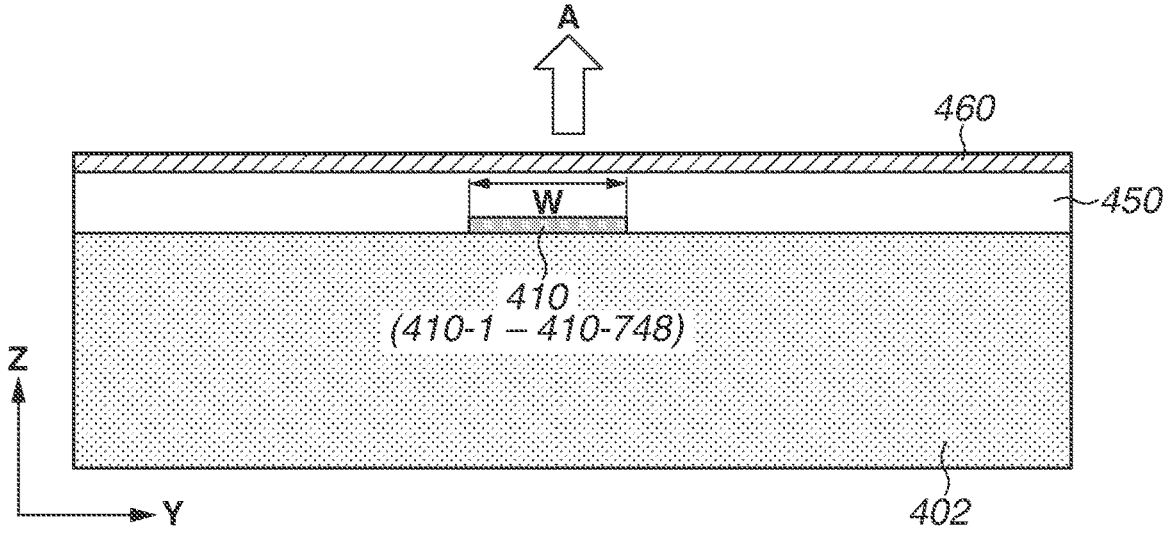

The substrate 502 having the OLED will be described in more detail with reference to FIGS. 7A to 7C. The X-direction illustrated in FIGS. 7A to 7C indicates the longitudinal direction of the exposure head 105. A Z-direction is a direction in which layers of a layer structure to be described below are stacked (stacking direction). FIG. 7A is an enlarged view illustrating a major part of the schematic view of a section taken along a line A-A in FIG. 6. FIG. 7A is a schematic view of lower electrodes 410-1 to 410-748 to be described below as viewed in the Y-direction. As illustrated in FIGS. 7A and 7B, the substrate 502 includes the silicon substrate 402, the lower electrodes 410-1 to 410-748, the light-emitting layer 450, and an upper electrode 460. The silicon substrate 402 is a drive substrate on which a drive circuit including drive portions corresponding to the respective lower electrodes 410-1 to 410-748 to be described below is formed in a manufacturing process.

As illustrated in FIGS. 7A and 7B, the lower electrodes 410-1 to 410-748 (cathodes) are a plurality of electrodes formed on the silicon substrate 402 as a layer (first electrode layer). The lower electrodes 410-1 to 410-748 are formed on a plurality of drive portions incorporated in the silicon substrate 402 through a manufacturing process of manufacturing the silicon substrate 402 and by using an Si integrated circuit processing technique. The lower electrodes 410-1 to 410-748 may be desirably made of metal having a high reflectance with respect to the emission wavelength of the light-emitting layer 450 to be described below. Accordingly, the lower electrodes 410-1 to 410-748 may desirably contain argentum (Ag), aluminum (Al), or an alloy of these materials, or an alloy of silver and magnesium.

Figure 7C:
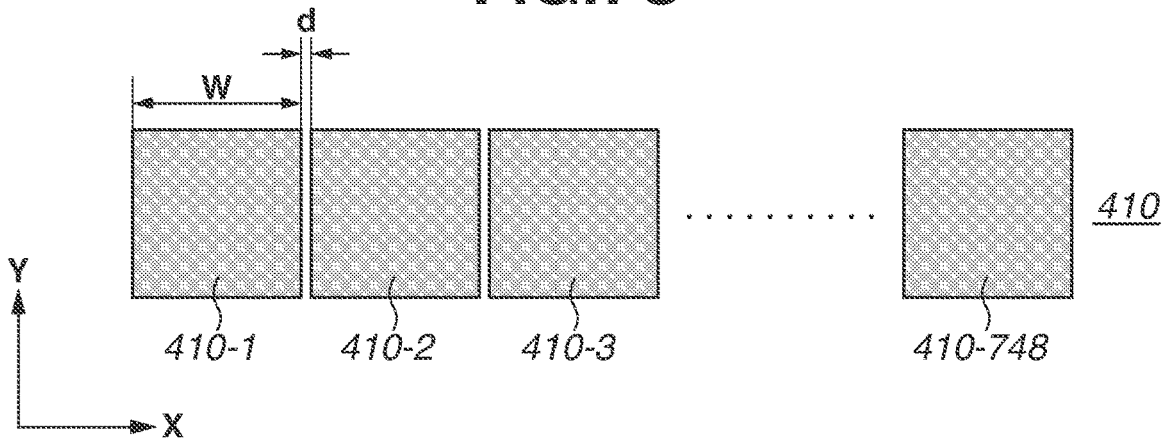

As illustrated in FIG. 7C, the lower electrodes 410-1 to 410-748 are provided in correspondence with respective pixels in the X-direction. In other words, each of the lower electrodes 410-1 to 410-748 is provided to form a pixel. The lower electrodes 410-1 to 410-748 form a first electrode row. The lower electrodes 410-1 to 410-748 that form the first electrode row are arranged in the rotational axis direction of the photosensitive drum 103. In this case, the lower electrodes 410-1 to 410-748 may be arranged with an inclination of about ±1° with respect to the rotational axis direction of the photosensitive drum 103. The lower electrodes 410-1 to 410-748 need not necessarily be arranged in parallel to the rotational axis direction of the photosensitive drum 103.

A width W of each of the lower electrodes 410-1 to 410-748 in the X-direction is a width corresponding to a width of one pixel. An interval d is a distance between lower electrodes in the X-direction (array interval). Adjacent ones of the lower electrodes 410-1 to 410-748 are formed at the interval d on the silicon substrate 402. A plurality of drive units formed on the silicon substrate 402 can individually control voltages of the lower electrodes 410-1 to 410-748. The organic material of the light-emitting layer 450 is filled in the interval d, and the lower electrodes 410-1 to 410-748 are partitioned by the organic material.

The shape of each lower electrode 410 is not limited to a square shape, but instead may be any shape, such as a polygonal shape with four or more sides, a circular shape, or an elliptical shape, as long as light with a sufficiently high intensity for the size of the exposure region corresponding to the output resolution of the image forming apparatus can be emitted and the image quality of an output image obtained by the light satisfies the design specifications of the mage forming apparatus.

Next, the light-emitting layer 450 will be described. The light-emitting layer 450 is stacked and formed on the silicon substrate 402 on which the lower electrodes 410-1 to 410-748 are formed. Specifically, in a portion where the lower electrodes 410-1 to 410-748 are formed, the light-emitting layer 450 is stacked on the lower electrodes 410-1 to 410-748. In a portion where the lower electrodes 410-1 to 410-748 are not formed, the light-emitting layer 450 is stacked on the silicon substrate 402. The present exemplary embodiment illustrates an example where the light-emitting layer 450 is formed across the lower electrodes 410-1 to 410-748 in the light-emitting device 401. However, the present exemplary embodiment is not limited to this example. For example, as in the lower electrodes 410-1 to 410-748, the light-emitting layer 450 may be stacked and formed separately on the respective lower electrodes, or the lower electrodes 410-1 to 410-748 may be divided into a plurality of groups and a single light-emitting layer may be stacked on the lower electrode belonging to the corresponding one of the divided groups.

For example, an organic material can be used for the light-emitting layer 450. The light-emitting layer 450 serving as an organic EL film has a laminate structure including function layers, such as an electron transport layer, a hole transport layer, an electron-injection layer, a hole-injection layer, an electron block layer, and a hole block layer. Not only an organic material, but also an inorganic material may be used for the light-emitting layer 450.

The upper electrode 460 (anode) is stacked (as a second electrode layer) on the light-emitting layer 450. The upper electrode 460 is an electrode that enables light with the emission wavelength of the light-emitting layer 450 to be transmitted. Accordingly, in the upper electrode 460 used in this example, a material containing Indium Tin Oxide (ITO) is used as a transparent electrode. An electrode made of ITO has a transmittance of 80% or more with respect to light in a visible light region, and thus the electrode is suitably used as an organic EL electrode.

The upper electrode 460 is formed on the opposite side of the lower electrodes 410-1 to 410-748 with at least the light-emitting layer 450 interposed therebetween. Specifically, in the Z-direction, the light-emitting layer 450 is disposed between the upper electrode 460 and the lower electrodes 410-1 to 410-748, and the region in which the lower electrodes 410-1 to 410-748 are formed is included in the region in which the upper electrode 460 is formed when the lower electrodes 410-1 to 410-748 are projected on the upper electrode 460 in the Z-direction. The transparent electrode need not necessarily be stacked on the entire light-emitting layer 450. However, in order to effectively emit the light generated in the light-emitting layer 450 to the outside of the light-emitting device 401, the occupied area of the upper electrode 460 may be preferably 100% or more, and more preferably, 120% or more with respect to the occupied area of one pixel. An upper limit of the occupied area of the upper electrode 460 can be optionally designed depending on the area of the silicon substrate 402 and the area of the light-emitting layer 450. Wiring may be provided in a portion other than the portion where light is transmitted in the upper electrode 460.

The drive circuit controls the potentials of the lower electrodes 410-1 to 410-748 based on image data so that a potential difference can be generated between the upper electrode 460 and any one of the lower electrodes 410-1 to 410-748.

An example of the substrate 502 including the OLED as described above is a top-emission-type light-emitting device. When a voltage is applied to the upper electrode 460 serving as the anode and to each lower electrode 410 serving as the cathode and a potential difference is generated between these electrodes, electrons flow into the light-emitting layer 450 from the cathode and holes flow into the light-emitting layer 450 from the anode. In the light-emitting layer 450, electrons and holes are recombined, so that the light-emitting layer 450 emits light. When the light-emitting layer 450 emits light, the light directed toward the upper electrode 460 is transmitted through the upper electrode 460 and is emitted in a direction indicated by an arrow A illustrated in FIGS. 7A and 7B from the light-emitting device 401. The light directed toward each lower electrode 410 from the light-emitting layer 450 is reflected toward the upper electrode 460 by each lower electrode 410, and the reflected light is also transmitted through the upper electrode 460 and is emitted from the light-emitting device 401. There is a time difference between a timing when light is directly emitted from the light-emitting layer 450 to the upper electrode 460 and a timing when light is reflected by each lower electrode 410 and is emitted from the upper electrode 460. However, since the layer thickness of the light-emitting device 401 is extremely small, it can be considered that the light is emitted substantially at the same time.

The use of the transparent electrode, such as an electrode made of ITO, as the upper electrode 460 makes it possible to set an opening ratio indicating a light transmission ratio of the electrode to be substantially equal to the transmittance of the upper electrode 460. In other words, except for the upper electrode 460, there is substantially no portion in which light is attenuated or shielded. Accordingly, the light emitted from the light-emitting layer 450 is less likely to be attenuated or shielded.

In a case where a light-emitting material vulnerable to water, such as an organic EL layer or an inorganic EL layer, is used for the light-emitting layer 450, the light-emitting layer 450 may be desirably sealed to prevent water from penetrating into the light-emitting region 604. As a sealing method a single thin film made of, for example, a silicon oxide, a silicon nitride, and an aluminum oxide is formed, or a sealing film obtained by stacking thin films is formed. As a method for forming the sealing film, a method excellent in coating performance for a structure, such as a step, is desirable. For example, an atomic layer deposition method (ALD method) or the like can be used.

As described above, in a case where the OLED is used as the light source for emitting light to expose the photosensitive drum 103, the upper electrode 460 is formed over the light-emitting layer 450. The term "light-emitting surface" of the substrate 502 refers to the surface of the substrate 502 on which the upper electrode 460 is formed. In other words, the surface of the substrate 502 on which light is emitted from the OLED is defined as the "light-emitting surface".

Figure 8A:
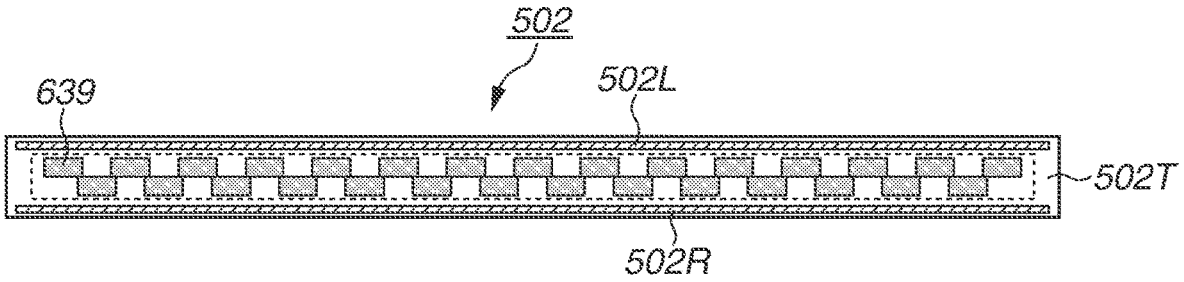
FIGS. 8A and 8B are diagrams each illustrating a light-emitting surface and a mounting surface of the substrate.
Figure 8B:
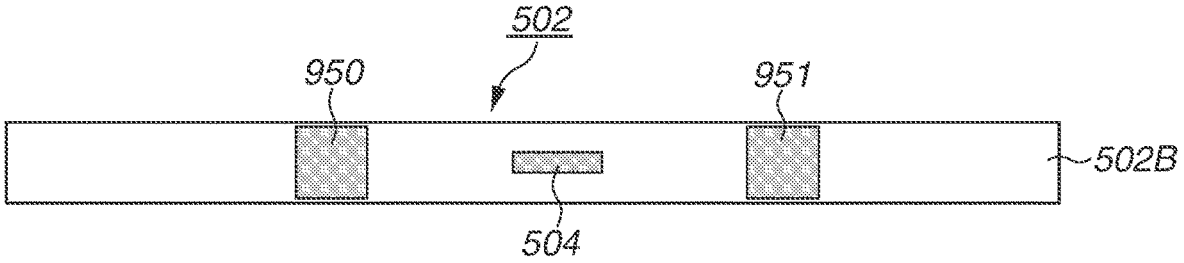

FIGS. 8A and 8B are diagrams illustrating a portion of a light-emitting surface 502T of the substrate 502 that contacts the holding member 505 according to the present exemplary embodiment. The substrate 502 that also uses the LEDs 503, which is not made of an organic EL, as the light source will be described below by way of example.

FIG. 8A is a diagram illustrating the light-emitting surface 502T of the substrate 502 when the light-emitting surface 502T is viewed in the direction vertical to the light-emitting surface 502T. In FIGS. 8A and 8B, the Y-direction corresponds to the transverse direction of the substrate 502 and the X-direction corresponds to the longitudinal direction of the substrate 502. The LED chips 639 are arranged in the longitudinal direction of the substrate 502.

In this case, regions 502R and 502L indicated by shaded areas in the substrate 502 illustrated in FIG. 8A are regions that contact the holding member 505. As illustrated in FIG. 8A, the region 502R is located on the right end side of the substrate 502 in the transverse direction, and the region 502L is located on the left end side of the substrate 502 in the transverse direction. Each LED chip 639 is provided between the region 502R and the region 502L. Specifically, a leading edge of the extended portion 5050R of the holding member 505 to be described below contacts the right side (one end side) of the light-emitting surface 502T relative to the LED chip 639 in the transverse direction, and a leading edge of the extended portion 5050L of the holding member 505 to be described below contacts the left side (the other end side) of the light-emitting surface 502T relative to the LED chip 639 in the transverse direction. In other words, the "light-emitting surface" is the surface of the substrate 502 on which the photosensitive drum 103 is disposed, or the surface including the LEDs 503 (light-emitting portions). The LEDs 503 are excluded from the region that contacts the holding member 505. That is, the holding member 505 does not contact the LEDs 503.

It is desirable that the width of the substrate 502 in the transverse direction fall within the range from 5 mm to 10 mm. In order to expose the photosensitive drum 103 to light, the LED print head 105 is to be located within close vicinity of the photosensitive drum 103. However, since the charger 104 and the developing unit 641 are present in the vicinity of the photosensitive drum 103, there is a need to increase the size of the image forming apparatus 1 itself to ensure a sufficiently large space. Therefore, it may be desirable to design the width of the substrate 502 to be less than or equal to 10 mm.

On the other hand, there is a need to provide a space for mounting wiring for driving the LED chips 639 and electronic components 950 and 951 to be described below in the substrate 502. Accordingly, even in a case where the width of the substrate 502 in the transverse direction is reduced, the width of about 5 mm is required.

FIG. 8B is a diagram illustrating a mounting surface 502B corresponding to the back surface of the substrate 502. The mounting surface 502B is provided with the electronic components 950 and 951 for driving the LED chips 639. Examples of the electronic components 950 and 951 include one or more driver integrated circuits (ICs). In the present exemplary embodiment, the connector 504 is provided between the electronic components 950 and 951. Power is supplied to the electronic components 950 and 951 through the connector 504. In view of the stability during mass production of the substrate 502 and the stability in the quality of the substrate 502, it is not preferable to provide the electronic components 950 (951) and a wiring pattern near end portions of the substrate 502. Accordingly, it is desirable that a space with a size of about 1 mm to 2 mm be provided in a region from the electronic components 950 (951) and the wiring pattern to the end portions of the substrate 502. Considering all these circumstances, it is desirable that the width of the substrate 502 in the transverse direction be set to more than or equal to 5 mm.

As seen from FIGS. 8A and 8B, the region 502R, which is a region that contacts a leading edge 5051R of the extended portion 5050R, and the region 502L, which is a region that contacts a leading edge 5051L of the extended portion 5050L, partially overlap the electronic components 950 and 951 when the substrate 502 is viewed in the direction vertical to the substrate 502. The width of the substrate 502 is minimized in such a manner, thus preventing the width of the holding member 505 itself from being increased.

(Shape of Holding Member)

Figure 9:
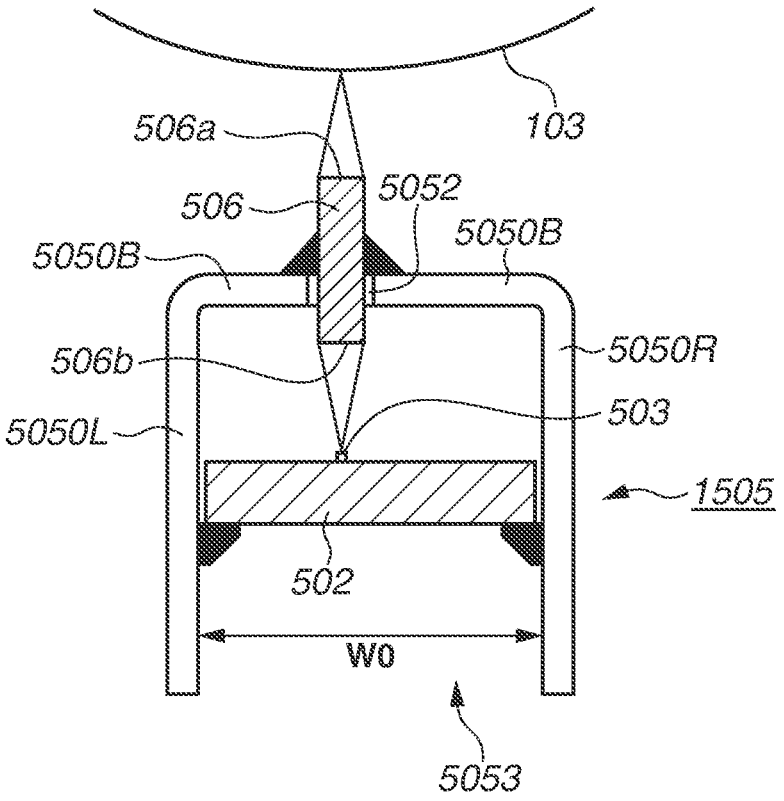
FIG. 9 is a diagram illustrating a conventional LED exposure head.

FIG. 9 is a diagram illustrating a holding member 1505 of related art. The holding member 1505 includes the base portion 5050B provided with an opening 5052 into which the lens array 506 is inserted, and the extended portions 5050R and 5050L extended from the right and left ends of the base portion 5050B in the direction away from the photosensitive drum 103. The base portion 5050B and the extended portions 5050R (5050L) are integrated together and form a U-shape. Since the holding member 1505 has a U-shape, an opening 5053 is formed on the opposite side of the base portion 5050B. The substrate 502 is inserted from the lower side of the opening 5053, i.e., from the lower side of the holding member 1505 having a U-shape, and is bonded to the inside of the extended portion 5050R and the inside of the extended portion 5050L with an adhesive. The lens array 506 is also bonded to the base portion 5050B with an adhesive in a state where the lens array 506 is inserted into the opening 5052 formed in the base portion 5050B.

As described above, the substrate 502 and the lens array 506 are held by the holding member 1505, so that the LED 503 and an incoming surface 506*b* of the lens array 506 are opposed to each other. The light emitted from each LED 503 enters the incoming surface 506*b* and is then emitted to the photosensitive drum 103 from an outgoing surface 506*a*.

As described above, a conventional holding member 1505 holds a substrate 502 on the inside of a pair of extended portions 5050R (5050L). Accordingly, as illustrated in FIG. 9, an interval W0 between the extended portion 5050R and the extended portion 5050L, or the distance W0 between the pair of extended portions 5050R (5050L) is to be set to be greater than the width of the substrate 502 in the transverse direction of the substrate 502. The substrate 502 cannot be inserted from the opening 5053 without increasing the distance W0 between the pair of extended portions 5050R (5050L) to be greater than the width of the substrate 502. Accordingly, the width of the holding member 1505 is greater than at least the sum of the width of the substrate 502, the width of the extended portion 5050R, and the width of the extended portion 5050L.

Next, a configuration for mounting the holding member 505 and the substrate 502 according to the present exemplary embodiment will be described with reference to FIGS. 10A to 10C.

Figure 10A:
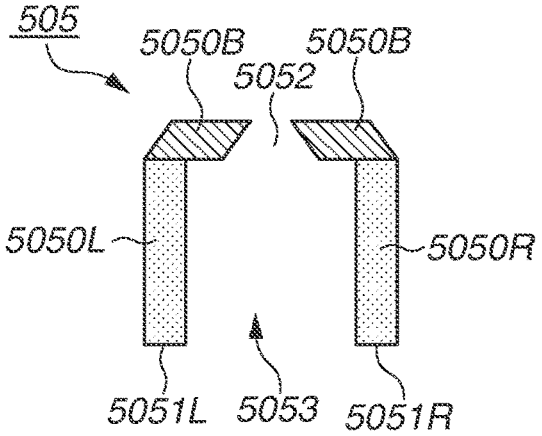
FIGS. 10A, 10B, and 10C are diagrams each illustrating a configuration for mounting the holding member and the substrate according to a first exemplary embodiment.

FIG. 10A is a schematic sectional view of the holding member 505 according to the present exemplary embodiment. This section corresponds to the section of the holding member 505 that is taken along the plane S illustrated in FIG. 3. As illustrated in FIG. 10A, the holding member 505 includes the base portion 5050B provided with the opening 5052, and the extended portions 5050R (5050L) extended from the both ends of the base portion 5050B in the direction away from the photosensitive drum 103. The extended portion 5050R is extended from the right-side end of the base portion 5050B in the direction away from the photosensitive drum 103 and the extended portion 5050L is extended from the left-side end of the base portion 5050B in the direction away from the photosensitive drum 103, thus forming a U-shape. The phrase "direction away from the photosensitive drum 103" used herein indicates the direction opposite to the direction in which light is emitted from each LED 503 in the direction along the optical axis of a certain lens included in the lens array 506. The phrase "the extended portions 5050R (5050L) are extended from the base portion 5050B" does not mean that the holding member 505 is manufactured by extending the extended portions 5050R (5050L) from the base portion 5050B in the manufacturing process of the holding member 505. Metal and resin can be used as a material for the holding member 505. In a case where the holding member 505 is made of metal, a U-shaped holder may be formed by bending a plate, or a U-shaped holder may be formed by cutting a metal block. That is, there is no need to form the holder by preparing the base portion 5050B and then extending the extended portions 5050R (5050L). In a case where resin is used as a material for the holding member 505, the resin material is poured into a prepared mold and is solidified to form the holding member 505. Also, in this case, there is no need to form the holder by solidifying the portion corresponding to the base portion 5050B and then extending the extended portions 5050R (5050L) from the base portion 5050B.

The lens array 506 is inserted into the opening 5052 formed in the base portion 5050B. The extended portion 5050R and the extended portion 5050L are opposed to each other at an interval. Thus, the opening 5053 is formed. The leading edge 5051R of the extended portion 5050R and the leading edge 5051L of the extended portion 5050L contact the light-emitting surface 502T of the substrate 502. More specifically, the leading edge 5051R of the extended portion 5050R contacts the region 502R of the light-emitting surface 502T of the substrate 502, and the leading edge 5051L of the extended portion 5050L contacts the region 502L of the light-emitting surface 502T of the substrate 502 (see FIGS. 8A and 8B).

Figure 10B:
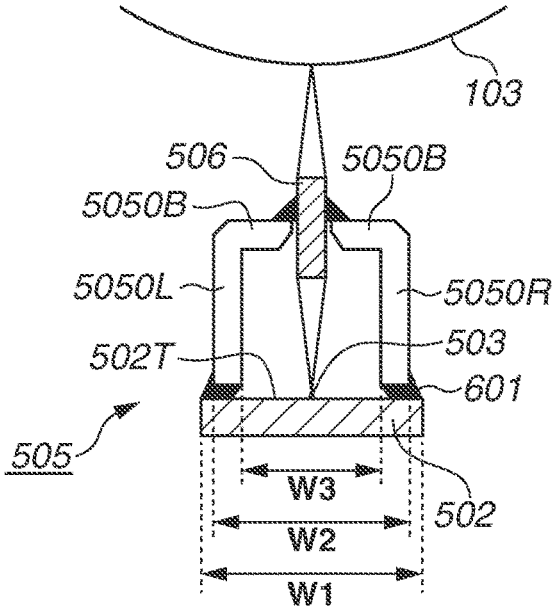

FIG. 10B is a diagram illustrating a state where the substrate 502 is bonded to the holding member 505. In this manner, the extended portion 5050R and the substrate 502 are bonded with an adhesive 601 in a state where the leading edge 5051R of the extended portion 5050R is in contact with the light-emitting surface 502T of the substrate 502. Similarly, the extended portion 5050L and the substrate 502 are bonded with the adhesive 601 in a state where the leading edge 5051L of the extended portion 5050L is in contact with the light-emitting surface 502T of the substrate 502. In the present exemplary embodiment, the adhesive 601 is filled in a gap between the leading edge 5051R of the extended portion 5050R and the light-emitting surface 502T of the substrate 502. This state is defined as a state where the leading edge 5051R and the light-emitting surface 502T of the substrate 502 are in contact with each other. As a matter of course, the adhesive 601 need not necessarily be present between the leading edge 5051R and the light-emitting surface 502T of the substrate 502. Specifically, the leading edge 5051R and the light-emitting surface 502T of the substrate 502 may be in direct contact with each other without using an adhesive or the like. For example, a side surface of the extended portion 5050R and the substrate 502 may be bonded with an adhesive.

Moreover, on the left side of the holding member 505, the adhesive 601 is filled in a gap between the leading edge 5051L of the extended portion 5050L and the light-emitting surface 502T of the substrate 502. In the present exemplary embodiment, this state is defined as a state where the leading edge 5051L and the light-emitting surface 502T of the substrate 502 are in contact with each other. As a matter of course, the adhesive 601 need not necessarily be present in the gap between the leading edge 5051L and the light-emitting surface 502T of the substrate 502. Specifically, the leading edge 5051L and the light-emitting surface 502T of the substrate 502 may be in direct contact with each other without using an adhesive or the like. For example, a side surface of the extended portion 5050L and the substrate 502 may be bonded with an adhesive. As the adhesive used in the present exemplary embodiment, an ultraviolet (UV) curable adhesive that is an acrylic adhesive obtained by filling glass filler or the like as a component. The substrate 502 is positioned with respect to the holding member 505 on which the lens array 506 is mounted, while the distance between the lens array 506 and the LEDs 503 on the substrate 502 is adjusted, and the adhesive 601 is filled in the gap between the holding member 505 and the substrate 502 in this state. After that, the adhesive 601 is irradiated with ultraviolet light to fix the substrate 502 to the holding member 505.

As illustrated in FIG. 10B, in this example, a width W1 of the substrate 502 is greater than an interval W2 between a wall surface on the outside of the extended portion 5050R and a side surface on the outside of the extended portion 5050L. As a matter of course, since the width W1 of the substrate 502 is greater than an interval W3 between the extended portion 5050R and the extended portion 5050L, the substrate 502 does not pass through the opening 5053.

Thus, the extended portion 5050R (5050L) and the substrate 502 are arranged so that the leading edge 5051R of the extended portion 5050R and the leading edge 5051L of the extended portion 5050L are brought into contact with the light-emitting surface 502T of the substrate 502. This configuration makes it possible to reduce the width of the holding member 505 as compared with conventional ones.

Figure 10C:
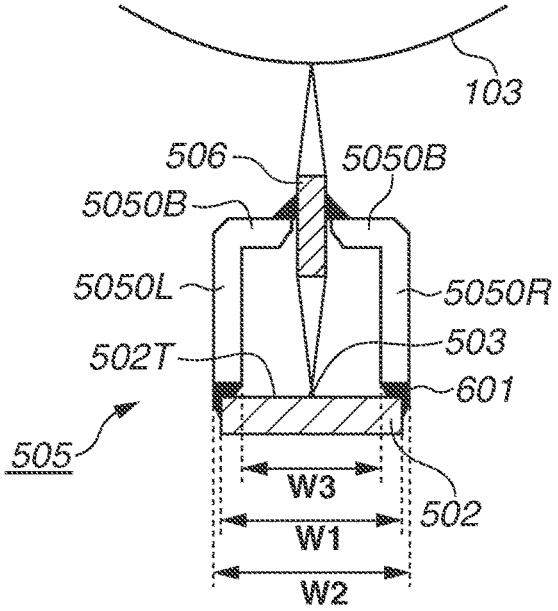

FIG. 10C is a diagram illustrating a variation of the configuration for mounting the holding member 505 and the substrate 502. Members including the same functions as those denoted by the same reference symbols used in the description with reference to FIG. 10B are denoted by the same reference symbols. In this example, the interval W2 between the wall surface on the outside of the extended portion 5050R and the side surface on the outside of the extended portion 5050L is greater than the width W1 of the substrate 502. Since the width W1 of the substrate 502 is greater than the interval W3 between the extended portion 5050R and the extended portion 5050L, the substrate 502 does not pass through the opening 5053.

As illustrated in FIG. 10B, when the width W1 of the substrate 502 is greater than the interval W2 between the wall surface on the outside of the extended portion 5050R and the side surface on the outside of the extended portion 5050L, the area of a contact portion between the substrate 502 and the leading edge 5051R of the extended portion 5050R and the leading edge 5051L of the extended portion 5050L can be increased as compared with the configuration illustrated in FIG. 10C. Accordingly, the substrate 502 can be held more stably by the holding member 505.

On the other hand, in the configuration illustrated in FIG. 10C, the width W1 of the substrate 502 is minimized, and thus the width of the portion corresponding to the substrate 502 can be further reduced as compared with the configuration illustrated in FIG. 10B. Thus, the configurations illustrated in FIGS. 10B and 10C have their own advantages.

Figure 11A:
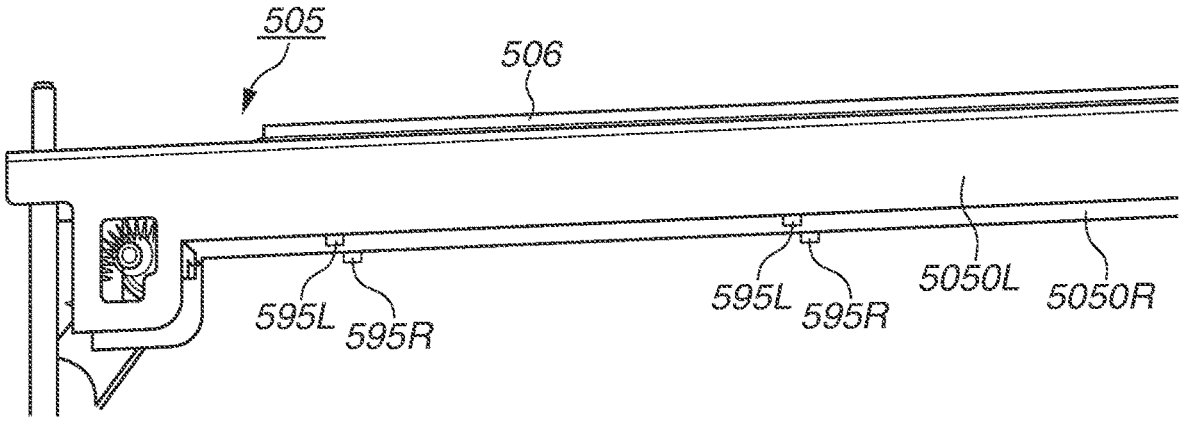
FIGS. 11A, 11B, and 11C are views each illustrating protrusions that contact the substrate and are provided on the holding member according to the first exemplary embodiment.
Figure 11B:
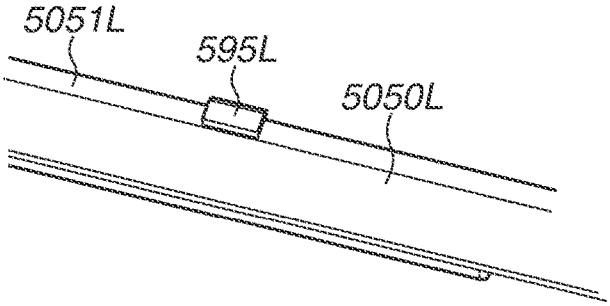
Figure 11C:
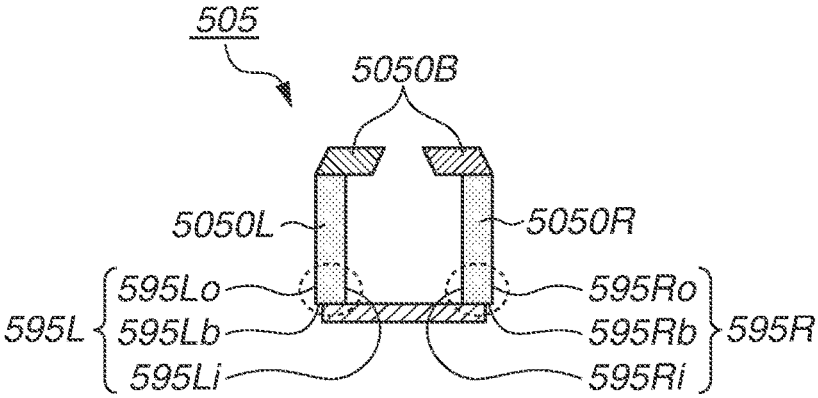

FIGS. 11A to 11C are views each illustrating a portion of the holding member 505 that contacts the substrate 502. FIG. 11A is a diagram illustrating the holding member 505 as viewed from the lower side. As illustrated in FIG. 11A, a plurality of protrusions 595R projecting downward is discretely formed at the leading edge of the extended portion 5050R. Similarly, a plurality of protrusions 595L projecting downward is discretely formed at the leading edge of the extended portion 5050L. The protrusions 595R and the protrusions 595L will be described in detail below. The light-emitting surface 502T of the substrate 502 contacts the protrusions 595R and the protrusions 595L.

Thus, the leading edges 5051R (5051L) of the extended portions 5050R (5050L) do not contact the entire area of the substrate 502, but the contact portion is limited, thus increasing the accuracy of the positioning plane and favorably maintain the flatness of the bonded substrate 502.

FIG. 11B is an enlarged perspective view of each protrusion 595L. Since each protrusion 595R has the same configuration as that of each protrusion 595L, only the configuration of each protrusion 595L will now be described. As illustrated in FIG. 11B, the protrusion 595L formed on the leading edge 5051L of the extended portion 5050L has a rectangular parallelepiped shape. In particular, in a case where the holding member 505 is made of resin, for example, only the portion corresponding to the protrusion is formed with higher accuracy than in the other portions, thus considerably improving the positioning accuracy of the substrate 502.

FIG. 11C is a sectional view of the holding member 505 that is taken along a line vertical to the longitudinal direction of the holding member 505 in such a manner that the line passes through the protrusion 595R and the protrusion 595L.

Areas surrounded by broken lines in FIG. 11C indicate a leading edge side of the extended portion 5050R and a leading edge side of the extended portion 5050L, respectively. In other words, the phrase "leading edge side of the extended portion 5050R" indicates the region that is surrounded by a broken line and includes the protrusion 595R. Similarly, the phrase "leading edge side of the extended portion 5050L" indicates the region that is surrounded by a broken line and includes the protrusion 595L.

As illustrated in FIG. 11C, the protrusion 595R includes three regions, i.e., an outside wall portion 595Ro, an inside wall portion 595Ri, and a leading edge 595Rb. Among these regions, the leading edge 595Rb contacts the substrate 502. In this case, the leading edge 595Rb may correspond to the leading edge of the protrusion 595R and may also correspond to the leading edge of the extended portion 5050R. Similarly, the protrusion 595L includes three regions, i.e., an outside wall portion 595Lo, an inside wall portion 595Li, and a leading edge 595Lb. Among these regions, the leading edge 595Lb contacts the substrate 502. In this case, the leading edge 595Lb may correspond to the leading edge of the protrusion 595L and may also correspond to the leading edge of the extended portion 5050L. In other words, the leading edge 595Rb of the protrusion 595R corresponds to the leading edge 5051R of the extended portion 5050R. The leading edge 595Lb of the protrusion 595L corresponds to the leading edge 5051L of the extended portion 5050L.

In this manner, in the leading edge of the extended portion 5050R, a portion where the protrusion 595R is formed contacts the substrate 502. On the other hand, in the leading edge of the extended portion 5050R, a gap corresponding to a projecting amount of the protrusion 595R is formed between the substrate 502 and the portion where the protrusion 595R is not formed. By applying an adhesive to the portion corresponding to the gap, the leading edge of the extended portion 5050R and the substrate 502 are bonded and fixed together.

Similarly, in the leading edge of the extended portion 5050L, a portion where the protrusion 595L is formed contacts the substrate 502. On the other hand, in the leading edge of the extended portion 5050L, a gap corresponding to a projecting amount of the protrusion 595L is formed between the substrate 502 and the portion where the protrusion 595L is not formed. By applying an adhesive to the portion corresponding to the gap, the leading edge of the extended portion 5050L and the substrate 502 are bonded and fixed together.

Thus, the leading edge of the extended portion 5050R and the leading edge of the extended portion 5050L include a portion that contacts the substrate 502 and a portion that does not contact the substrate 502 (adhesive is present). However, as described above, the term "contact" indicates not only a case where the leading edges of the extended portions 5050R (5050L) contact the substrate 502 without involving an adhesive, but also a case where the adhesive is present between the substrate 502 and the leading edges of the extended portions 5050R (5050L).

A second exemplary embodiment of the present disclosure will be described below. In the first exemplary embodiment, the leading edges 5051R (5051L) of the pair of extended portions 5050R (5050L) of the holding member 505 are brought into contact with the light-emitting surface 502T of the substrate 502. The second exemplary embodiment illustrates a configuration in which only the leading edge of one of the pair of extended portions is brought into contact with the light-emitting surface 502T of the substrate 502.

Figure 12:
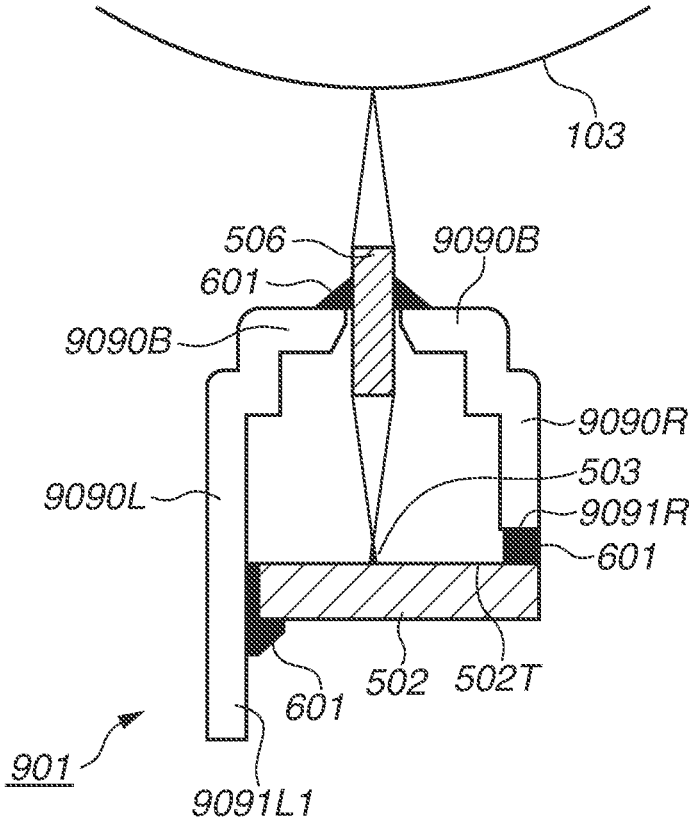
FIG. 12 is a diagram illustrating a configuration for mounting the holding member and the substrate according to a second exemplary embodiment.

FIG. 12 is a diagram illustrating a sectional structure of a holding member 901 according to the second exemplary embodiment. Members including the same functions as those described in the first exemplary embodiment are denoted by the same reference symbols.

The holding member 901 according to the second exemplary embodiment includes a base portion 9090B and a pair of extended portions 9090R (9090L) extended from the base portion 9090B, and has a U-shape. As in the holding member 505 according to the first exemplary embodiment, the base portion 9090B is provided with an opening into which the lens array 506 is inserted, and the lens array 506 and the base portion 9090B are bonded with the adhesive 601 in a state where the lens array 506 is inserted into the opening.

The extended portion 9090R is extended from the right-side end of the base portion 9090B in the direction away from the photosensitive drum 103, and the extended portion 9090L is extended from the left-side end of the base portion 9090B in the direction away from the photosensitive drum 103.

As illustrated in FIG. 12, a leading edge 9091R of the extended portion 9090R is in contact with the light-emitting surface 502T of the substrate 502 via the adhesive 601. An inside surface 9090L1 of the extended portion 9090L and the substrate 502 are in contact with each other via the adhesive 601. More specifically, the surface (9090L1) where the substrate 502 is located on the leading edge of the extended portion 9090L is in contact with the left-side end face of the substrate 502. In this manner, the substrate 502 is held by the holding member 901.

As a matter of course, the leading edge of the extended portion 9090L may contact the light-emitting surface 502T of the substrate 502 and the inside (surface where the substrate 502 is disposed on the leading edge of the extended portion 9090R) of the extended portion 9090R may contact the right-side end face of the substrate 502.

Figure 13:
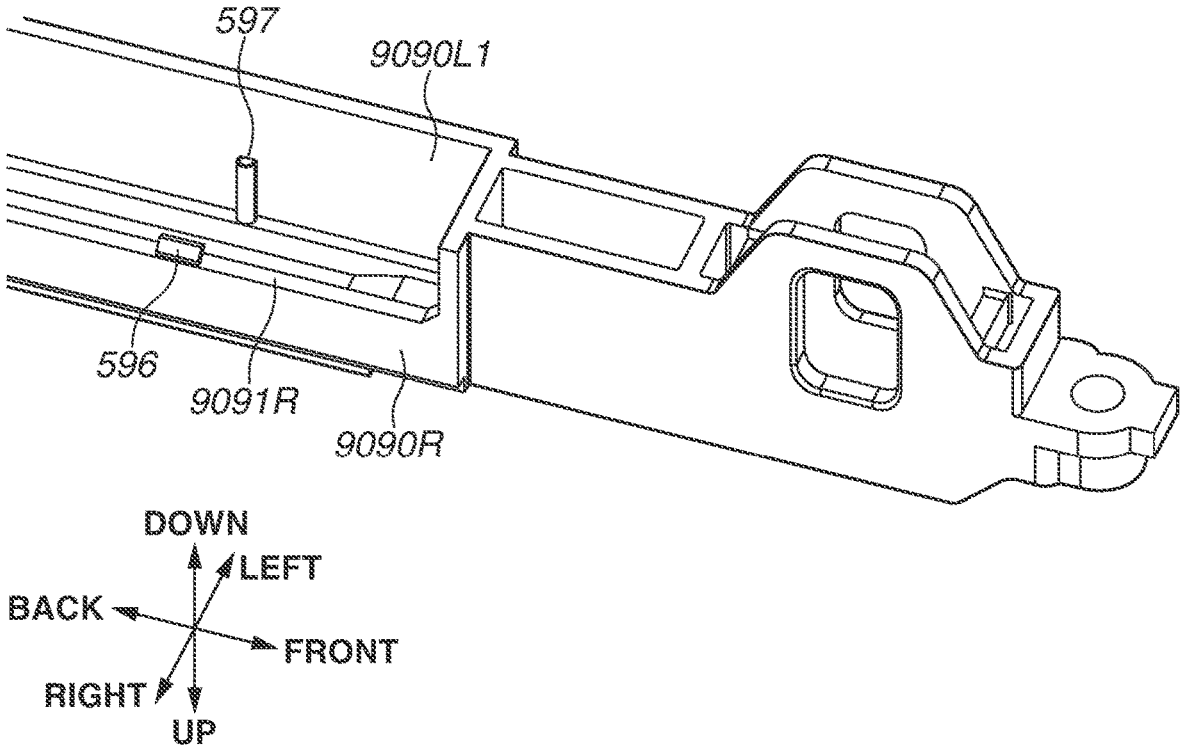
FIG. 13 is a view illustrating protrusions that contact the substrate and are provided on the holding member according to the second exemplary embodiment.

FIG. 13 is a view illustrating a configuration on the lower side of the holding member 901 according to the second exemplary embodiment. As illustrated in FIG. 13, a protrusion 596 is formed on the leading edge 9091R of the extended portion 9090R, as in the holding member 505 according to the first exemplary embodiment. A protrusion 597 is formed on the inside surface 9090L1 of the extended portion 9090L. These protrusions are discretely provided in the longitudinal direction of the holding member 901. Thus, the extended portions 9090R (9090L) do not contact the entire area of the substrate 502, but the contact portion is limited, thus increasing the accuracy of the positioning plane and favorably maintain the flatness of the bonded substrate 502.

As described above, according to the configuration described in the present exemplary embodiment, the width between a pair of extended portions constituting the holder of the LED print head can be made smaller than the width of the substrate. Consequently, it is possible to downsize the LED print head in the width direction.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-069490, filed Apr. 8, 2020, which is hereby incorporated by reference herein in its entirety.

What is claimed is:

1. A light-emitting element exposure head comprising:

a substrate;

a plurality of light-emitting elements configured to emit light and arranged in a first direction on a surface of the substrate;

a lens array including a plurality of lenses arranged in the first direction, wherein the lens array is configured to condense the light emitted from the plurality of light-emitting elements; and a holder configured to hold the lens array and having a base portion configured to hold the lens array, a first extending portion extending from of the base portion toward the surface of the substrate, and a second extending portion extending from the base portion toward the surface of the substrate, wherein the plurality of light-emitting elements is positioned between the first extending portion and the second extending portion in a second direction which is orthogonal to the first direction and is parallel to the surface of the substrate, wherein the base portion, the first extending portion, and the second extending portion are positioned between one end of the substrate and the other end of the substrate in the second direction, wherein a leading edge of the first extending portion in a third direction is bonded to the surface of the substrate, a leading edge of the second extending portion in the third direction is bonded to the surface of the substrate, and the third direction orthogonal to the surface of the substrate, and wherein, when the holder is viewed along the third direction, a width of the substrate in the second direction is longer than a width of the holder in the second direction.

2. The light-emitting element exposure head according to claim 1, wherein an electronic component configured to drive the plurality of light-emitting elements is provided on a surface of the substrate that is opposite to the surface of the substrate on which the plurality of light-emitting elements is arranged and, when the holder is viewed from the third direction, a contact portion of the holder that contacts the substrate overlaps the electronic component.

3. The light-emitting element exposure head according to claim 1, further comprising a plurality of protrusions projecting in a direction that is opposite to the surface of the substrate on which the plurality of light-emitting elements is arranged, wherein the plurality of protrusions is discretely formed in the first direction of the holder, and wherein the holder and the substrate are bonded in a state where the plurality of protrusions is in contact with the substrate.

4. The light-emitting element exposure head according to claim 1, wherein a width of the substrate in a transverse direction falls within a range from 5 mm to 10 mm.

5. The light-emitting element exposure head according to claim 1, wherein the holder is a plate.

6. The light-emitting element exposure head according to claim 1, wherein each of the plurality of light-emitting elements is an organic light-emitting diode.

7. An image forming apparatus comprising:

a photosensitive member configured to be exposed to light by a light-emitting elements exposure head;

a charging unit configured to charge the photosensitive member;

a member charged by the charging unit to light, wherein the light-emitting element exposure head includes:

a substrate, a plurality of light-emitting elements configured to emit light and arranged in a first direction on a surface of the substrate, a lens array including a plurality of lenses arranged in the first direction, wherein the lens array is configured to condense the light emitted from the plurality of light-emitting elements, and a holder configured to hold the lens array and having a base portion configured to hold the lens array, a first extending portion extending from the base portion toward the surface of the substrate, and a second extending portion extending from the base portion toward the surface of the substrate, wherein the plurality of light-emitting elements is positioned between the first extending portion and the second extending portion in a second direction which is orthogonal to the first direction and is parallel to the surface of the substrate, wherein the base portion, the first extending portion, and the second extending portion are positioned between one end of the substrate and the other end of the substrate in the second direction, wherein a leading edge of the first extending portion is bonded to the surface of the substrate, and a leading edge of the second extending portion is bonded to the surface of the substrate, and wherein, when the holder is viewed along a third direction orthogonal to the surface of the substrate, a width of the substrate in the second direction is longer than a width of the holder in the second direction; and a developing unit configured to develop an electrostatic latent image formed on the photosensitive member exposed to light by the light-emitting element exposure head.

* * * * *